US007934357B2

(12) United States Patent
Watson

(10) Patent No.: US 7,934,357 B2
(45) Date of Patent: May 3, 2011

(54) JAM ACCESS SYSTEM FOR SHEET HANDLING APPARATUS

(75) Inventor: Peter J. Watson, Rayleigh (GB)

(73) Assignee: Pitney Bowes Ltd., Harlow, Essex (GB)

( * ) Notice: Subject to any disclaimer, the term of this patent is extended or adjusted under 35 U.S.C. 154(b) by 1640 days.

(21) Appl. No.: 11/034,127

(22) Filed: Jan. 12, 2005

(65) Prior Publication Data

US 2006/0151934 A1 Jul. 13, 2006

(51) Int. Cl.
*B65B 61/20* (2006.01)
*B65B 35/12* (2006.01)

(52) U.S. Cl. ..... 53/284.3; 53/537

(58) Field of Classification Search ..... 53/284, 53/284.3, 537
See application file for complete search history.

(56) References Cited

U.S. PATENT DOCUMENTS 4,841,329 A * 6/1989 Kasamura et al. ..... 399/226
5,180,157 A * 1/1993 Helit et al. ..... 271/256
5,289,251 A * 2/1994 Mandel et al. ..... 399/407
5,390,910 A * 2/1995 Mandel et al. ..... 271/296
5,685,531 A * 11/1997 Auerbach et al. ..... 270/51
5,839,045 A * 11/1998 Wierszewski ..... 399/382
5,924,686 A * 7/1999 Jacobson et al. ..... 271/3.17
6,251,055 B1 * 6/2001 Evers et al. ..... 493/419
6,453,647 B1 * 9/2002 Adams et al. ..... 53/460
6,607,190 B1 * 8/2003 Guiles et al. ..... 271/4.03
6,648,319 B2 * 11/2003 Chapman ..... 270/45
6,689,040 B2 * 2/2004 Ifkovits et al. ..... 493/419
6,694,116 B2 * 2/2004 Inoue et al. ..... 399/124
6,697,586 B2 * 2/2004 Yamamoto et al. ..... 399/110
6,790,303 B2 * 9/2004 Allen et al. ..... 156/196
6,985,687 B2 * 1/2006 Mochimaru et al. ..... 399/309
7,155,141 B2 * 12/2006 Sato et al. ..... 399/114
2003/0111787 A1 * 6/2003 Chapman ..... 270/45
2003/0163220 A1 * 8/2003 DiNapoli et al. ..... 700/222
2003/0173728 A1 * 9/2003 Stevens et al. ..... 270/52.01
2005/0254849 A1 * 11/2005 Honma ..... 399/80
2006/0033262 A1 * 2/2006 Stemmle ..... 271/258.01

* cited by examiner

*Primary Examiner* — Rinaldi I Rada
*Assistant Examiner* — Gloria R Weeks
(74) *Attorney, Agent, or Firm* — Brian A. Collins; Charles R. Malandra, Jr.

(57) ABSTRACT

A sheet handling device having at least one sheet feed path therethrough from an inlet to an outlet, the sheet feed path defined by a guide for directing sheet material from the inlet to the outlet. The sheet handling device comprising a plurality of processing sections located along the sheet feed path for performing a plurality of operations on sheet material being handled by the device. The processing sections including a central accumulator section, a collation section, a sheet folding section and at least one inserter section which are collectively located within a main chamber of the sheet handling device. The accumulator section is centrally located relative to the other processing sections and employs a vertically-oriented feed path to facilitate accumulation of sheet material while minimizing the spacing/gaps between adjacent sections. Furthermore, an access doorway is disposed over the processing stations to facilitate jam clearance.

9 Claims, 10 Drawing Sheets

JAM ACCESS SYSTEM FOR SHEET HANDLING APPARATUS

FIELD OF THE INVENTION

This invention relates to a jam access system for a sheet handling apparatus and a method for clearing a jammed sheet feed path and is applicable to an apparatus for processing of elongate elements or articles, and in particular to an apparatus and method for selectively performing a plurality of operations on each of a number of different sheet or booklet elements, as well as envelopes.

BACKGROUND OF THE INVENTION

It is well known to provide a machine for successively performing several operations on various sheet elements. For example, operations on an envelope might include flapping, inserting, moistening and sealing, whilst operations on one or more sheets might include collating, folding and inserting into an envelope. It is further known to provide a machine which collates several sheets of paper into a bundle, folds the bundle, places an insert, such as a leaflet or booklet into the bundle, provides an envelope which is held open, inserts the folded sheets into the envelope, moistens the envelope and seals it, before ejecting the envelope into a receiving tray or bin. Each of these operations is distinct and requires a separate and unique processing region within the machine in order to successfully and repeatably carry out the required operation on the respective element. As a result, folder/inserter machines of the type described hereinbefore are typically large and complicated to program.

Recently, there have been moves towards reducing the size of such folder inserter machines in order to make them more accessible to smaller businesses, such as SOHO (small office/home office) operations. In order to be successful in this environment, the folder/inserter must occupy a small footprint (i.e. the area of floor/desk-surface occupied), perform reliably, and be easy to control without requiring specialist training.

GB-A-2380157 discloses a small office folder/inserter having two trays, and for storing sheets to be folded and the other for storing inserts to be inserted into the sheets. One location is specified for folding said sheets, another location for placing the insert into the folded sheets, and a further location for inserting the folded bundle into an envelope. The machine further comprises a location for storing envelopes, means for opening said envelopes and holding the envelopes open to receive the folded bundle at the inserting location, a section for moistening the flap of the envelope and a section for closing the flap of the envelope to seal it and ejecting the envelope to a receiving tray. Because of the small size and compactness of the machine, it is suitable for performing only a limited number of cycles in a given time period, i.e. it does not have a very high-volume throughput. Further, such machines can lack versatility, since they are suitable only for performing the respective feeding, folding, inserting, envelope opening, envelope moistening and sealing operations on a limited range of sizes of sheets/inserts.

Large organizations, such as banks, telephone companies, supermarket chains and the government, for example, are often required to produce extremely large throughputs of specifically-addressed mail to a regional or national audience. Machines capable of producing the high volumes required, whilst simultaneously accurately ensuring that the correct content is sent to the individual recipients, are typically very large, often occupying an entire warehouse. By contrast, existing small office equipment is typically capable of producing mailshots for a few hundred to one or two thousand addressees.

Demand, therefore, exists for a machine of intermediate production capacity, typically for small to regional businesses, which does not occupy a vast quantity of the available office space. Particularly in large cities, office space is charged at premium rates for each square meter. As such, the cost of running and maintaining a folder/inserter will also comprise the cost of renting the office space which it occupies.

For folder/inserter apparatuses intended for small and medium sized businesses, it is at least desirable, if not necessary, for the machine to be able to accommodate a range of different materials. For example, it will be necessary to accommodate different thicknesses of sheet element, as well as different sizes and numbers thereof. Similarly, any materials to be inserted within a folded package might range from a compliments slip to an entire booklet, including inserts of unconventional size or shape. It is also advantageous for such machines to be able to accommodate different sizes of envelopes, such as A4 and A5, depending on the material to be inserted thereinto.

When designing paper handling machines which have many different subsystems a means is required to ensure that all areas within the machine can be clear of obstruction or damaged sheets in the case of a paper jam. This has been achieved on previous machines by having many different jam access areas around the machine, many of which rely on the user completely removing some parts to effectively clear the machine of jams. This also means many separate doors need to be interlocked, which can be costly.

SUMMARY OF THE INVENTION

According to the present invention, there is provided sheet handling apparatus having at least one sheet feed path therethrough from an inlet to an outlet, the sheet feed path defined by guiding means for directing sheet material from the inlet to the outlet, the apparatus comprising a plurality of processing sections located along the sheet feed path for performing a plurality of operations on sheet material being handled by the device, said processing sections including an accumulator section, characterized in that: the accumulator section is arranged within a main chamber of the sheet handling device and is configured to be accessible via an access doorway for jam clearance.

BRIEF DESCRIPTION OF THE DRAWINGS

For a better understanding of the invention and to show how the same may be carried into effect, reference will now be made, by way of example, to the accompanying drawings, in which.

DETAILED DESCRIPTION OF THE INVENTION

Throughout the drawings, like numerals are used to identify like components.

Figure 1:
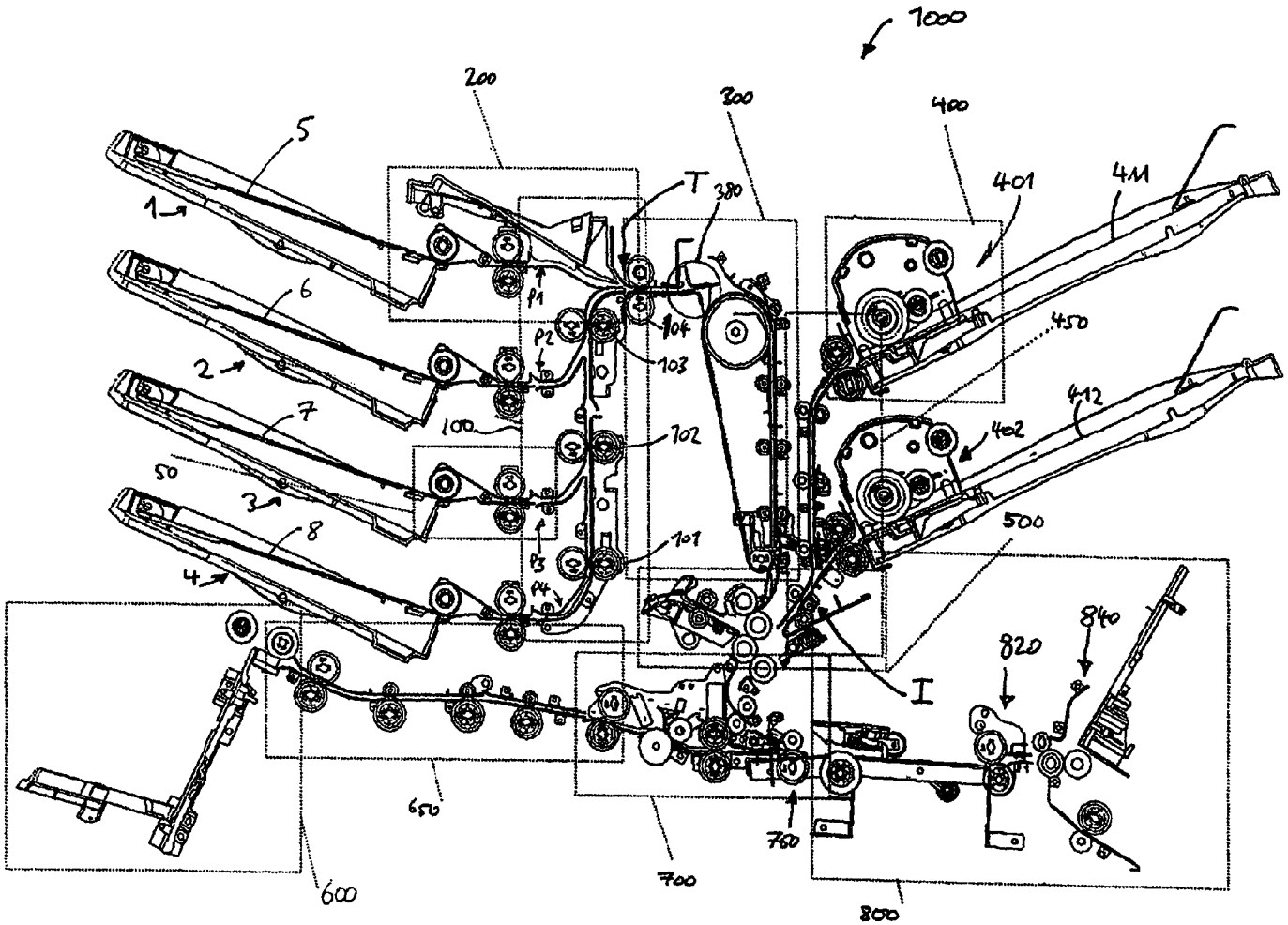
FIG. 1 is a cross-sectional view of a sheet handling apparatus detailing the different machine sections.

FIG. 1 shows a folder/inserter apparatus 1000 embodying the present invention. This embodiment is exemplary only, and is used to highlight and explain the inventive concept defined by the appended claims.

FIG. 1 shows a cross-sectional view of the folder/inserter apparatus 1000 and schematically shows various sections of the machine. The folder/inserter apparatus 1000 comprises a sheet feeder section including sheet feeders 1, 2, 3 and 4, from which sheets are fed into a collation section 100 where they are collated into an ordered paper stream. The paper stream is then fed along a sheet feed path which merges with an inlet from a convenience feeder 200, which acts as an alternative sheet feeder for certain documents. The sheets then pass through an accumulator section 300 where they are grouped together as an ordered and aligned package. From the accumulator, the sheets pass through a sheet folder 500. Inserts fed from insert feeders 401 and 402 are collated in an insert feeder collation section 450 and then fed into a folded collation. An envelope is fed from an envelope feeder 600 along an envelope transport path 650 to a flapper 700 where the envelope flap is opened and the mouth of the envelope held open at insertion section 750 to receive the folded collation. The collation is inserted into the envelope and the envelope is fed into a final section 800 where the gum on the envelope flap is moistened and the envelope sealed. The sealed envelope is then ejected into a receiving tray or bin.

Referring now to FIG. 1 in more detail, there is shown an inlet section which includes four sheet feeders 1, 2, 3 and 4. Each of these sheet feeders comprises a respective sheet feeder tray 5, 6, 7 or 8 into which a stack of sheets may be placed. The sheets in each tray are fed individually into a sheet feed path by respective sheet deskew mechanisms 50 which each act to separate a single sheet from the top of a stack of sheets in the associated sheet feeder tray and to feed the separated sheet into and along the sheet feed path. Four deskew mechanisms 50 are shown in FIG. 1, only one of which is identified by reference numeral 50 in FIG. 1. The other three deskew mechanisms are either identical or equivalent to that labeled 50. Each of the sheet feeder deskew mechanisms feeds into a common sheet feed path via respective sheet feeding inlet paths P1, P2, P3 and P4. The convenience feeder 200 similarly feeds into the common sheet feed path. All inlets to the sheet feed path from the four sheet feeders and from the convenience feeder 200 merge by a point T within the sheet feeder collation section 100. From the point T, the sheet feed path continues as a single sheet feed path up to the folder station 500. The sheet feed path passes first through the accumulator 300, where a plurality of sheets may be brought together to form an aligned and ordered package. The sheet feed path then passes through the sheet folding section 500 which produces a desired fold pattern in the accumulated document. As shown on the righthand side of FIG. 1, a pair of insert feeders 401, 402 are provided. Each insert feeder 401, 402 has a respective feeder tray 411, 412 which holds a plurality of inserts to be inserted into the folded collation. Each insert feeder further has an associated feeder device 400 for feeding a single insert into the insert collation section 450. Inserts fed into the insert collation section 450 are collated together and then inserted into the main folded collation. On the lefthand side of FIG. 1 below the sheet feeders 1, 2, 3 and 4 is located the envelope feeder 600. Envelope feeder 600 holds a plurality of envelopes which are fed along the envelope transport path 650 and into the flapper mechanism 700. The flapper mechanism 700 opens the flap of each envelope and uses mechanical fingers to hold the mouth of the envelope apart at insertion section 750 in order to allow the folded sheets (and any inserts) to be projected into the envelope. The envelope, with inserted documents, then continues along the sheet feed path to the final section 800 in which the gum on the envelope flap is moistened and the flap is sealed. The sealed envelope is then ejected from the folder/inserter apparatus 1000.

The operation of the folder/inserter apparatus is now considered in more detail with reference to FIGS. 2 to 6.

Figure 2:
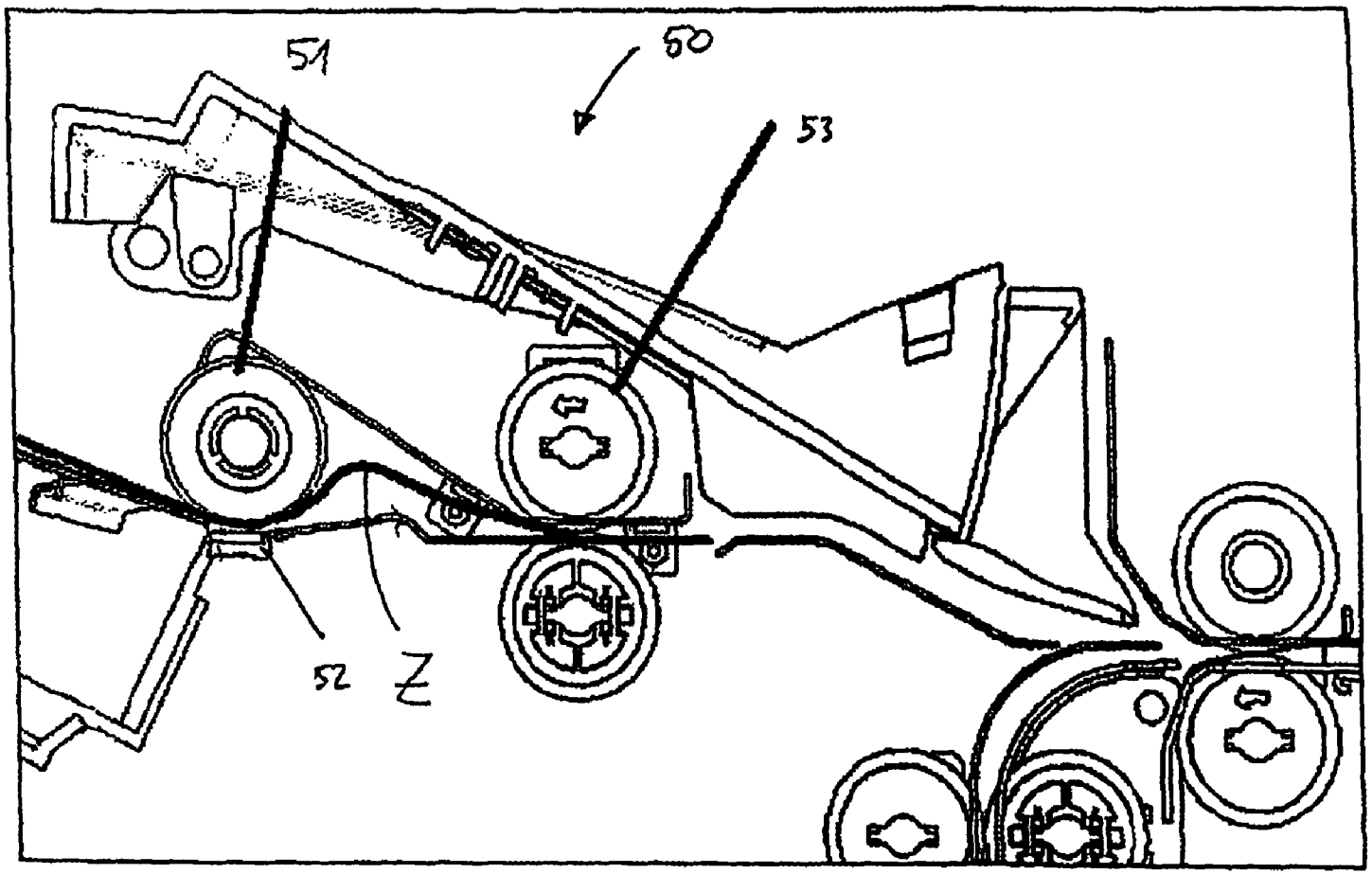
FIG. 2 is a cross-sectional view of a sheet feeder deskew mechanism.

Referring now to FIG. 2, the sheet feeder deskew mechanism 50 comprises a separator roller 51 which applies a driving force to the uppermost sheet in a stack in the sheet feeder tray. The separator roller 51 presses against a separator pad 52, normally in the form of a separator stone. This separator stone 52 prevents more than one sheet at a time from being fed into the sheet feed path by the roller 51. The single sheet removed from the sheet feeder tray by the separator roller 51 is then driven towards a deskew roller pair 53 which is maintained stationary. As the sheet engages the nip defined by the deskew roller pair 53 it is caused to buckle (as illustrated at Z). This forces the lead edge of the sheet to align with the nip of the deskew roller pair 53. The separator roller 51 is then stopped and the deskew roller pair 53 operated to drive the sheet along the sheet feed path and into the sheet feeder collation section 100.

Figure 3:
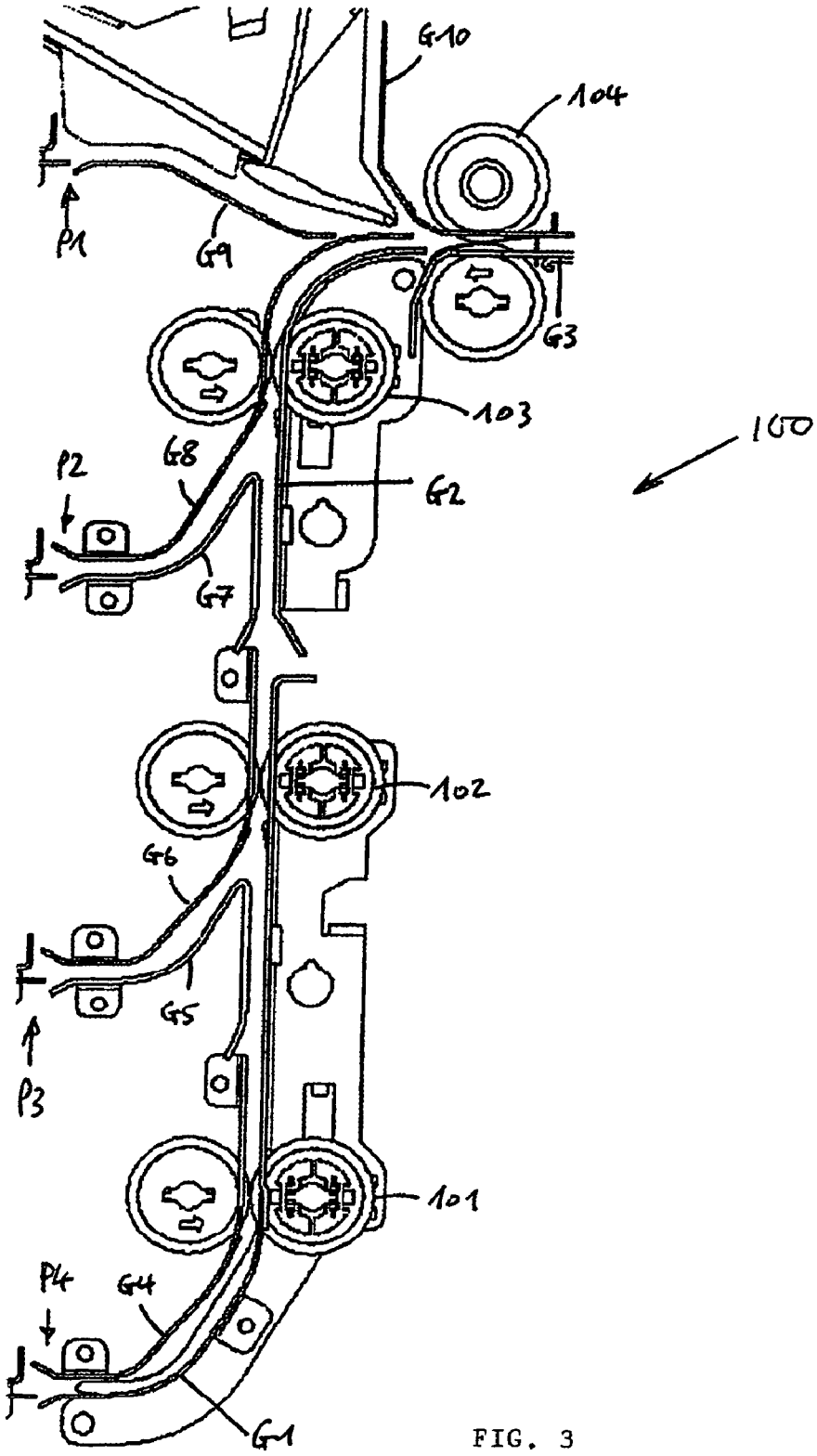
FIG. 3 is a cross-sectional view showing the sheet feeder collation section.

With reference to FIG. 3, each sheet fed from a sheet feeder 1, 2, 3 or 4 or convenience feeder is received in the respective sheet feeding inlet path P1, P2, P3, P4 or P5 defined by guides G1 and G4 to G10. The sheet feeding inlet paths merge into a single sheet feed path in the sheet feeder collation section 100. Sheet feeding roller pairs 101, 102, 103 and 104 are located along the sheet feed path for forcing the sheets along the sheet feed path.

In a typical sheet folding/inserting operation involving a four-page document, referring also to FIG. 1, the first sheet feeder tray 5 receives a stack of sheets corresponding to page 1 of the document, the second sheet feeder tray 6 receives a stack of sheets corresponding to page 2 of the document, the third sheet feeder tray 7 receives a stack of sheets corresponding to the page 3 of the document, whilst the fourth sheet feeder tray 8 receives a stack of sheets corresponding to page 4 of the document. A single sheet is then fed sequentially from each of the first to fourth sheet feeders. The first sheet from the first sheet feeder 1 passes into and along the sheet feeding inlet path P1 and partially along the common sheet feed path. A sheet is then fed from the second sheet feeder 2 such that the leading edge of the second sheet partially overlaps the trailing edge of the first fed sheet within the sheet feeder collation section 100. Similarly, the third sheet is fed so that the leading edge of the third sheet partially overlaps the trailing edge of the second sheet, whilst the fourth sheet is fed so that its leading edge partially overlaps the trailing edge of the third sheet. This forms a collation of the sheets along the sheet feed path in the sheet feeder collation section 100. The guides G1 to G10 defining the sheet feed path are configured and arranged to ensure that, as the sheets are sequentially fed into the sheet feed path and carried to overlap as described above, they become correctly collated in the intended order.

Because the requirement is that the adjacent sheets in the sheet collation only partially overlap at the leading and trailing edges, it is possible to drive the sheet collation along the sheet feed path at high speed without requiring a complex control system to ensure that each of the sheets is correctly aligned with those adjacent to it. This enables a high-volume throughput of mail packages to be achieved.

Figure 4:
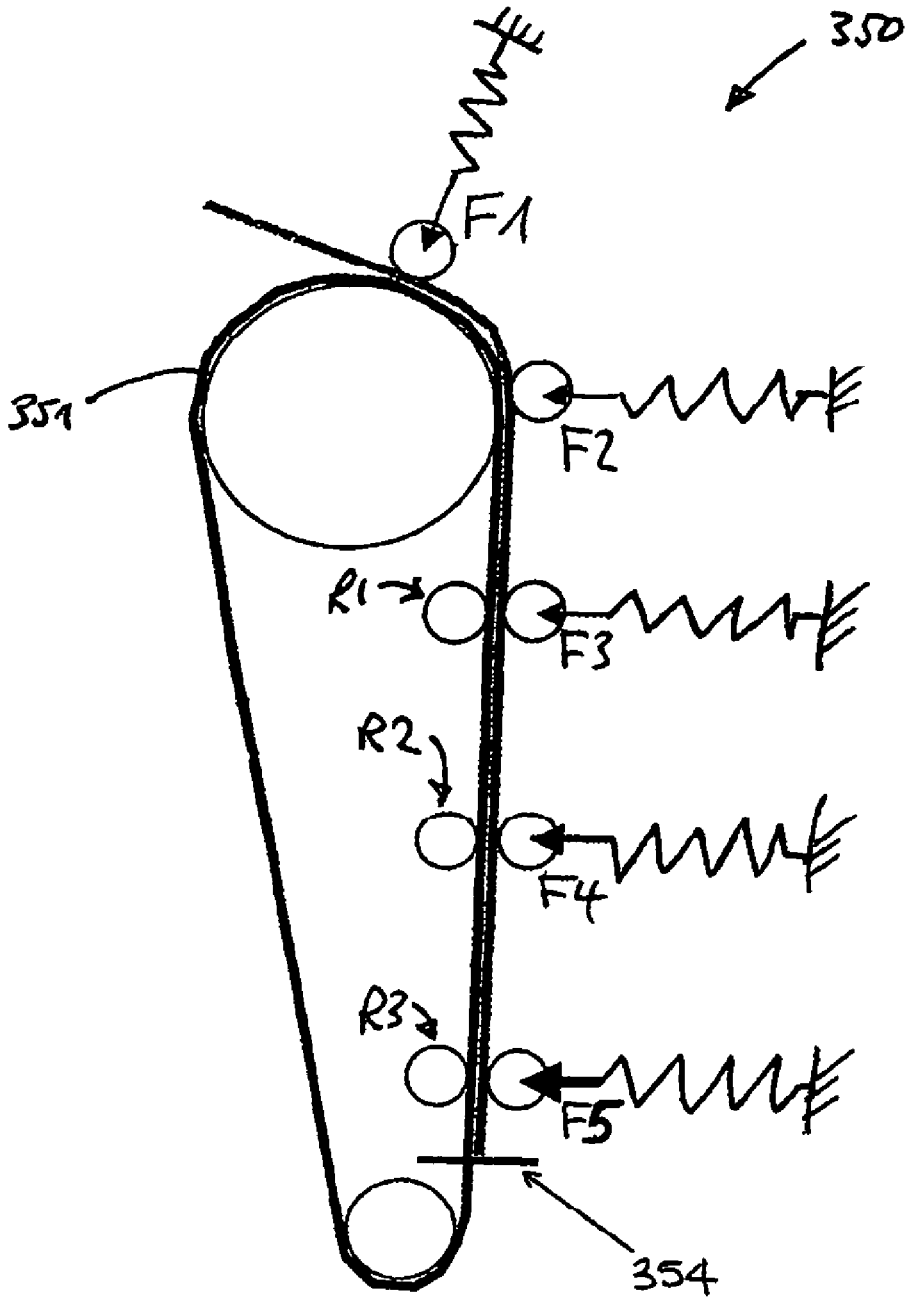
FIG. 4 is a schematic view of an accumulator according to an embodiment of the present invention.
Figure 5:
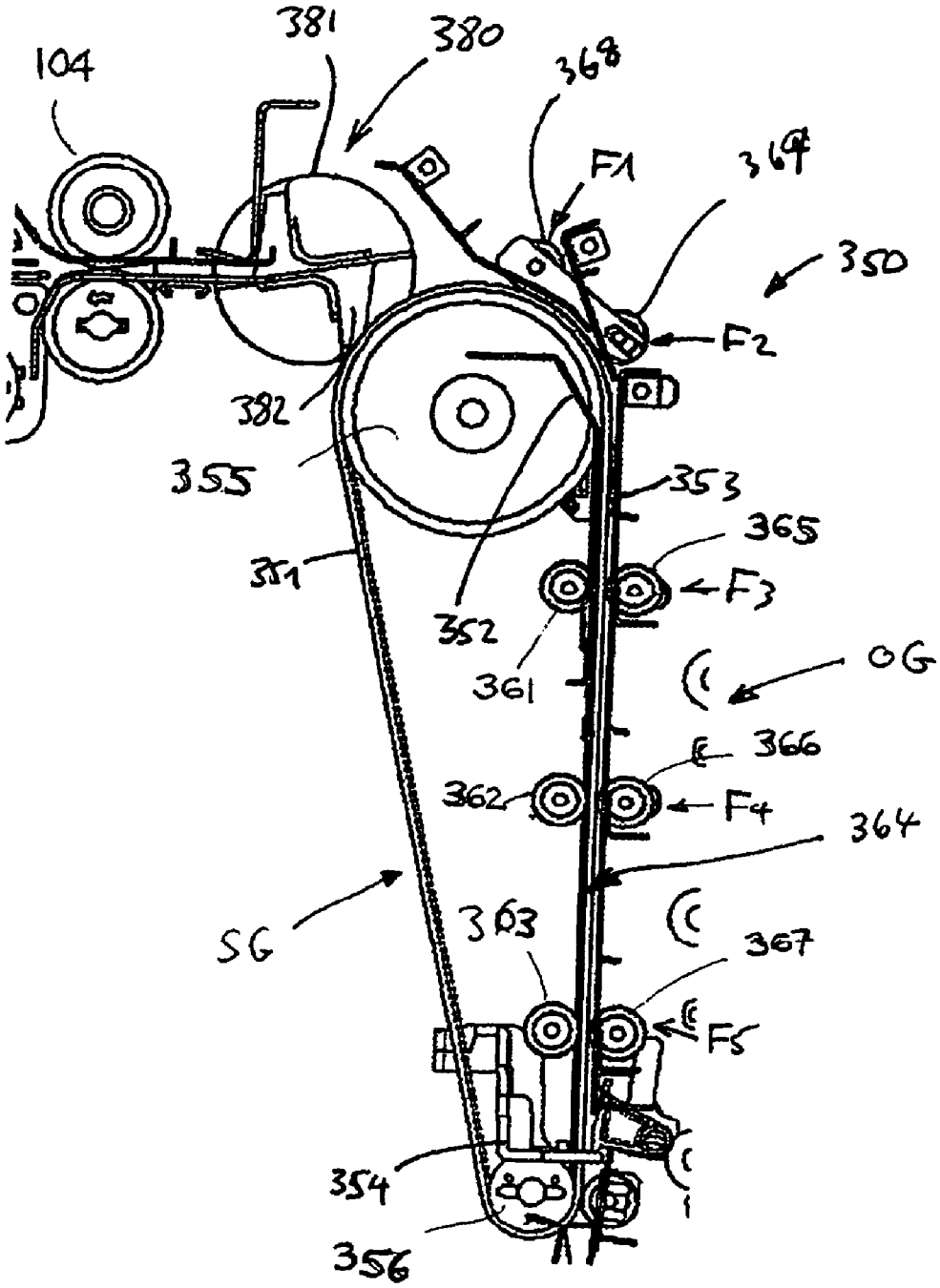
FIG. 5 is a cross-sectional view showing the accumulator installed in a sheet handling apparatus.

Referring now to FIGS. 4 and 5, the sheet collation is then driven from the collation section 100 into an accumulation section 300 comprising a vertical accumulator 350. Here, as each sheet arrives in the accumulator 350, it is gripped and forcibly advanced through the accumulator by a pair of traction belts 351 running vertically and mutually parallel on a sled 352. A plurality of spring-biased idler rollers 365 to 369 are provided for each traction belt 351 to apply forces F1 to F5 to maintain the most recently-arrived sheet in contact with the tractions belts 351. Each sheet fed into the accumulator 350 arrives at an accumulation chamber 364 defined on one side by a sled guide assembly SG including the sled 352 and the traction belts 351 and on the other side by a fixed guide assembly OG including fixed guide 353 and idler rollers 365 to 367. The accumulation chamber 364 is substantially straight and vertical, such that the collation is accumulated into a vertical stack of sheets. At the bottom of the accumulation chamber 364 is an accumulation gate 354 functioning as a stopping device. Each sheet entering the accumulator 350 is driven downwardly through the accumulation chamber 364 towards the accumulation gate 354 by the traction belts 351 until its leading edge comes into contact with the accumulation gate 354. This causes the sheet leading edge to impinge on the accumulation gate 354 and the sheet to become correctly aligned within the accumulation chamber 364. The sheet is then maintained within the accumulation chamber 364 and rests on the accumulation gate 354, whilst further driving of the traction belts causes slippage between the traction belts 351 and the sheet. Thus, once the first sheet has been stopped by the accumulation gate 354, the second and subsequent sheets are consecutively driven into alignment with the first sheet by the traction belts 351 driving each sheet in turn along the accumulation path and against the accumulation gate 354 to form an ordered collation. When all of the sheets in the collation have been successfully grouped at the accumulation gate 354, the accumulation gate opens to allow the collation to progress out from the accumulation chamber 364 along the continuation of the sheet feed path.

Referring now to FIG. 5, it can be seen that the accumulator comprises the fixed guide assembly OG, and movable sled guide assembly SG. The movable guide assembly SG includes driving means in the form of the pair of traction belts 351. The fixed guide assembly OG includes idler rollers 365 to 367 for pressing the sheets to be accumulated against the traction belt 351 and rollers 361 to 363 for pressing the traction belt against the sheets to be accumulated. The movable guide assembly also includes the sled 352 for assisting guidance of the sheets, or collations of sheets, into an accumulated bundle whilst accommodating a variable thickness of accumulation. These features define a section of sheet feed path which is substantially vertical and acts as the accumulation chamber 364. In the embodiment shown, the means for driving the sheets downwardly towards the accumulation gate 354 is the pair of traction belts 351, although any suitable system of belts and rollers could be used. The present embodiment has two drive belt assemblies which each consist of one of the traction belts 351, a drive roller 355 and a secondary tension roller 356 which holds the traction belt 351 under tension, along with idler rollers 361, 362, 363 in the sled 352 acting in opposition to the idler rollers 365 to 367 in the fixed guide assembly. The idler rollers 365 to 367 associated with the fixed guide 353 could alternatively take the form of miniature drive belts biased towards the fixed idler rollers 361, 362, 363 in the sled, but preferably sprung idler rollers are biased towards the traction belts. Further, idler rollers 368 and 369 are mounted on a further guide component positioned above guide 353 (see FIG. 5). The idler rollers 365 to 369 may be arranged to apply a force to the sheet which varies along the length of the accumulation chamber 364 and around the drive rollers 355 of the traction belt mechanisms 351. Such a variable traction force over the length of the accumulation chamber, preferably ensuring a larger force towards the bottom of the accumulation chamber, reduces the column strength of a sheet required to enable it to resist the frictional driving forces of the traction belts. In the present embodiment, the varied force is achieved by using sprung idler rollers 365, 366 and 367, each of which is biased towards the traction belts 351 by a different spring force, the spring force being largest for roller 367 and least for roller 365. The downward driving force is resisted at the bottom of the accumulator by the accumulation gate 354, but it is important that the traction forces from the driving means do not cause the individual sheets to buckle or concertina.

In traditional accumulators, the accumulated collation must be mechanically forced in order to propel it further along the sheet feed path. Because contact can be achieved only with the front and rear sheets at any time, the acceleration given to the accumulated collation must be limited in order to ensure that adjacent sheets do not slide relative to one another, thereby spreading apart the accumulated collation. As a result of the vertical orientation of the accumulation path in the present embodiment, a downward acceleration of 1 g (i.e. under gravitational force) can be achieved without mechanical forcing. In addition, using additional forcing methods, a further acceleration of 1 g may be imparted to the collation without resulting in the separation of adjacent sheets. Hence, accumulated collations emerging from the accumulator 350 of the present embodiment may be accelerated at roughly 2 g without resulting in sliding separation of the sheets. This allows for faster progression of the accumulated collation through the folder/inserter 1000, resulting in a higher-volume throughput of sheet packages.

Referring again to FIGS. 4 and 5, the operation of the accumulator 350 will be described in more detail.

As already outlined, as the sheet collation enters the accumulation section, the individual sheets are engaged by the pair of accumulator driving belts 351. At the accumulator inlet side, a pair of drive rollers 104 (FIG. 5) feeds the sheet material along the sheet feed path towards the drive belts 351. The drive belts 351 are stopped whilst the drive rollers 390 continue to feed a sheet into the accumulator 350. This allows subsequent sheets arriving after the first to be effectively overlapped with the sheet or sheets already in the accumulator 350 to ensure that they are engaged by driving means 351 and accumulated in the correct order.

According to the present embodiment, there are three methods by which a document may be fed into and accumulated in the accumulator. The first is as described above, where individual sheets are fed from the separate feed trays 1, 2, 3, 4 (FIG. 1), loosely collated in the sheet feeder collation section 100, and then accumulated in the accumulator 350. In this mode, the sheets pass directly into the accumulation chamber in the correct order because they are already partially overlapped. As such, the second and subsequent sheets are always received between the sheet(s) already present in the accumulator and the traction belts 351, so that they are driven downwardly and accumulated against the accumulation gate 354 in the correct order.

The folder/inserter may also operate in two further modes for folding a mail piece and inserting it into an envelope. According to the second method, pre-stapled sheets, for example a five-page document stapled in one corner, are placed in the convenience tray 200. This document is then fed directly to the accumulation chamber, where no further accumulation is required owing to the sheets being stapled. The document then exits the accumulation chamber and is folded and inserted as normal.

According to the third method of operation, a plurality of ordered, loose sheets are placed in convenience feeder 200 or one of the sheet feeder trays 5, 6, 7 or 8 (FIG. 1). These sheets are fed successively one-at-a-time along the sheet feed path and into the accumulator. However, in this mode, the sheets are not partially overlapped in the paper feed path, and this leads to the risk that the sheets will become incorrectly ordered, or incorrectly fed into the accumulator, leading to mis-collated mail packages or a jam in the folder/inserter machine 1000.

To overcome this problem, a trail edge deflector 380 is provided (FIGS. 1, 5). In the third mode, the trail edge deflector acts to lift the trail end of a sheet whose lead end is already in the accumulator 350, to thereby ensure that the subsequent sheet to arrive is fed into the accumulator between the previous sheet and the traction belts 351. The trail edge deflector 380 comprises a roller 381 through which there is a passage 382 suitable for allowing one or a plurality of sheets to pass through the roller. The passage is flared at the inlet and outlet thereof to better accept the introduction of a sheet leading edge, to prevent jamming of the folder/inserter 1000.

In the first and second modes the sheet(s) or stapled document(s), etc. simply pass through the passage in the deflector and into the accumulator.

In the third mode of operation, the sheets arriving individually pass part-way through the passage, and the leading edge of the sheet enters the accumulator 350 and is contacted by the traction belts 351 to drive it down against the accumulation gate 354. As the trail edge of each sheet reaches the trail edge deflector, the deflector rotates by 180° (anticlockwise as shown in FIG. 5). This forces the trail edge of that sheet upwards and it then lies above the trail edge deflector. The inlet and outlet of the passage 382 through the trail edge deflector have then reversed positions and the subsequent sheet enters the passage through what was previously the outlet. This is possible because the passage has a cross-section with rotational symmetry. The subsequent sheet is then guaranteed to be fed into the accumulator underneath the trail edge that was previously deflected, i.e. between the previous sheet and the traction belts.

This third mode of operation is particularly useful when, for example, a document has been printed by a laser jet printer and is collated in the correct order, and it is not desired to have to sort the individual pages of the document into the appropriate individual sheet feed trays.

After leaving the accumulator, the collation passes into the folding section 500 which contains a variable folding apparatus. The operation of such a folding apparatus is known, for example from GB-A-2380157. Brief explanation is given here for a more complete understanding.

Figure 6:
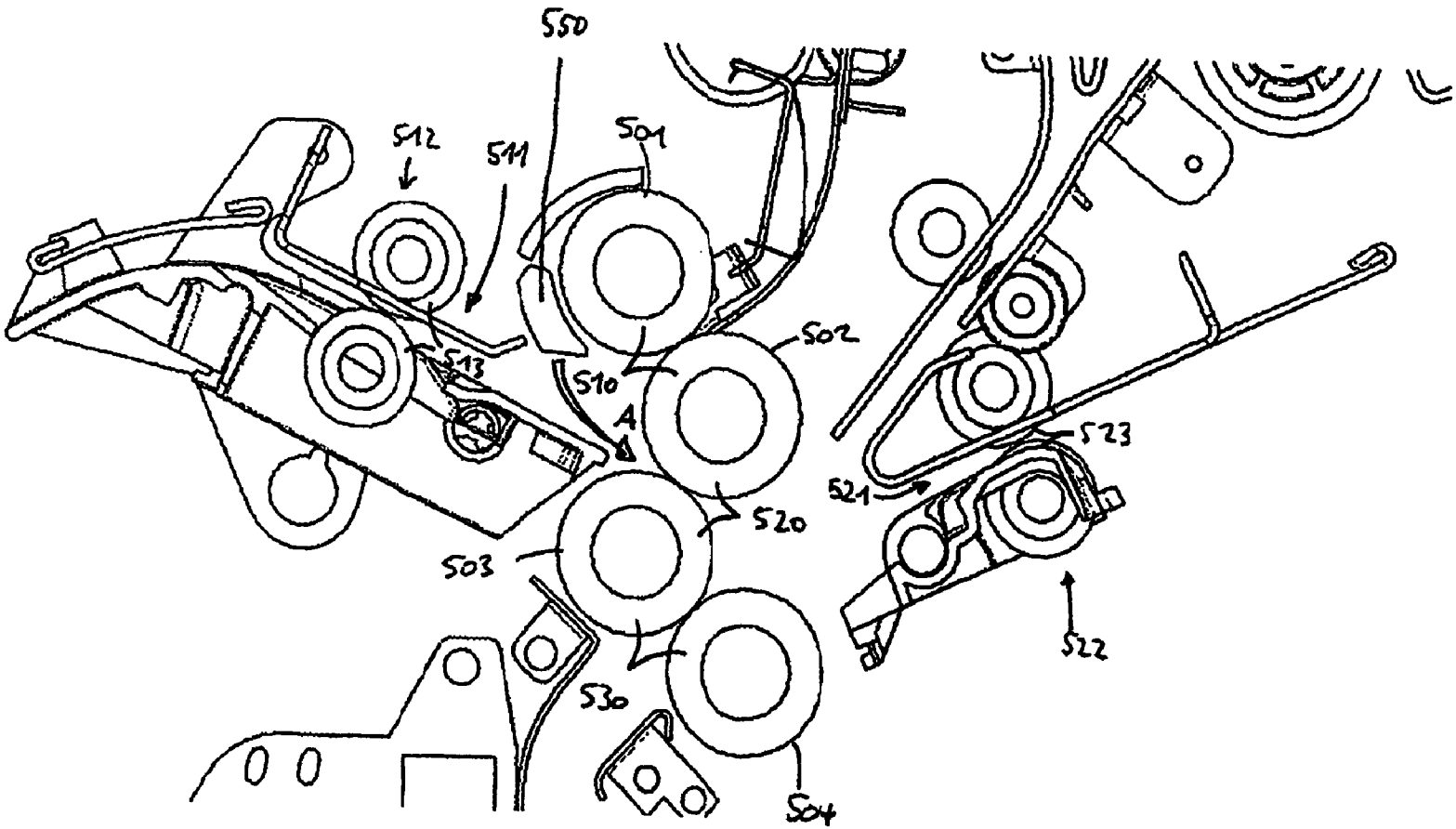
FIG. 6 is a cross-sectional view showing the sheet folding section.

Referring to FIG. 6, the folding apparatus comprises four rollers 501, 502, 503 and 504 arranged to form three pairs 510, 520 and 530. The leading edge of the collation passes through the first roller pair 510 and into a buckle chute 511 until it reaches an adjustable stop 512, here constituted as a pinch roller pair 513 which selectively stops the collation based on detection of the leading edge position. At this point, the first roller pair continues to feed the sheet collation, causing it to buckle, and causing the buckled portion to enter the nip between the second roller pair 520. This results in the buckled portion being fed through the second roller pair 520 and forming a fold at the buckle, at a predetermined position. The folded edge then becomes the lead edge of the collation and it is fed through the second roller pair 520 into a second buckle chute 521 until it moves into contact with a second stop 522 (which is preferably a pinch roller pair 523) which halts its movement. The second roller pair 520 continues to feed the trailing edge of the sheet collation therethrough. Again, this causes the collation to buckle, and the second buckle is forced into the nip of the third roller pair 530, resulting in a second fold in the sheet collation at a predetermined point in the region of the second buckle.

By selectively determining the point at which the sheet collation is halted by the stops 512, 522 at each stage, it is possible to always achieve the folds in the desired position. Further, by appropriately selecting the distance from the roller pairs at which the collation is halted, the same apparatus can selectively perform either a double fold, a "Z" fold or a "C" fold in the sheet collation. Equally, the sheet collation need only be folded a single time, for example simply folded in half. This single fold is achieved by operation of a half-fold mechanism 550. If a half-fold operation is selected, the half-fold mechanism 550 moves in the direction of arrow A to an interference position where it intercepts and redirects the accumulated collation as it exits the first roller pair 510. The collation is then directed immediately through the second roller pair 520, rather than into the first buckle chute 511. Accordingly, the first fold is never made in the collation at the nip of the second roller pair, and only a single fold is created as the collation is buckled in the second buckle chute 521 and the buckle passes through the third roller pair 530, as normal.

Referring again to FIG. 1, after the final fold is made, one or more inserts may be fed from insert feeders 401 and 402 shown on the right hand side of FIG. 1. The present embodiment has two insert feeders 401 and 402, which both feed an insert into and along an insert feed path. One or both inserts are then collated in the insert feeder collation section 450 and the collated inserts are held at insert staging area I whilst the sheets are folded. These collated inserts are then fed into the final fold in the sheet collation and form part of the folded document. Typically, these inserts might be booklets, business reply envelopes, compliment slips, product samples, etc. of varied shape, size, thickness and pliability.

Below the sheet feeders 1 to 4 is located the envelope feeder 600. This holds a plurality of envelopes in a stack, and has an associated mechanism for removing the single uppermost envelope from the stack and feeding said envelope along the envelope transport path 650. The envelope first undergoes a flapping process in flapper section 700, in which the flap is opened. The envelope is then held in the insertion region 750, where it is stopped. Mechanical fingers engage with and hold open the mouth of the envelope. In this state, the folded mail collation (including inserts) is inserted into the envelope by projecting the mail package towards the open mouth with sufficient velocity that its momentum will force it inside the envelope. This mail piece, comprising the folded mail package within the envelope, then proceeds to the sealing and ejection section 800. In the sealing and ejection section there is a moistening device 820 where the gum seal on the envelope flap is moistened. The envelope is then passed through a sealing/ejection mechanism 840. This performs a process which shuts and seals the moistened flap and ejects the envelope from the folder/inserter apparatus 1000 into a receiving tray or bin.

A critical design aspect considered during the design process is access to the internal components of the folder/inserter apparatus 1000. For many reasons, such as two misaligned sheets being placed in the feed trays, due to power faults or other controller-related problems, or simply due to the variation possible between different types of sheet material, it is common that a feed path blockage will occur during operation of a folder/inserter apparatus. Such a jam blocks the sheet feed path and cannot be recovered by the apparatus itself. Therefore, an operator must have access to the internal components of the machine in order to remove any sheets lodged along the sheet feed path in order to allow normal operation to resume.

Figure 8:
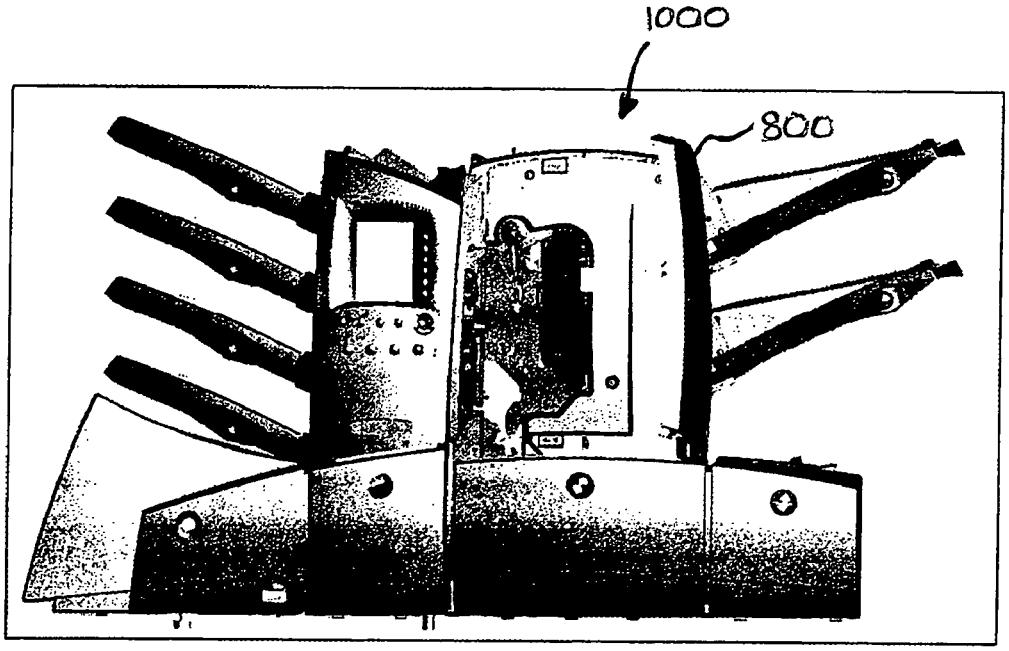
FIG. 8 shows a view corresponding to that of FIG. 8 with the access door in an open position.
Figure 9:
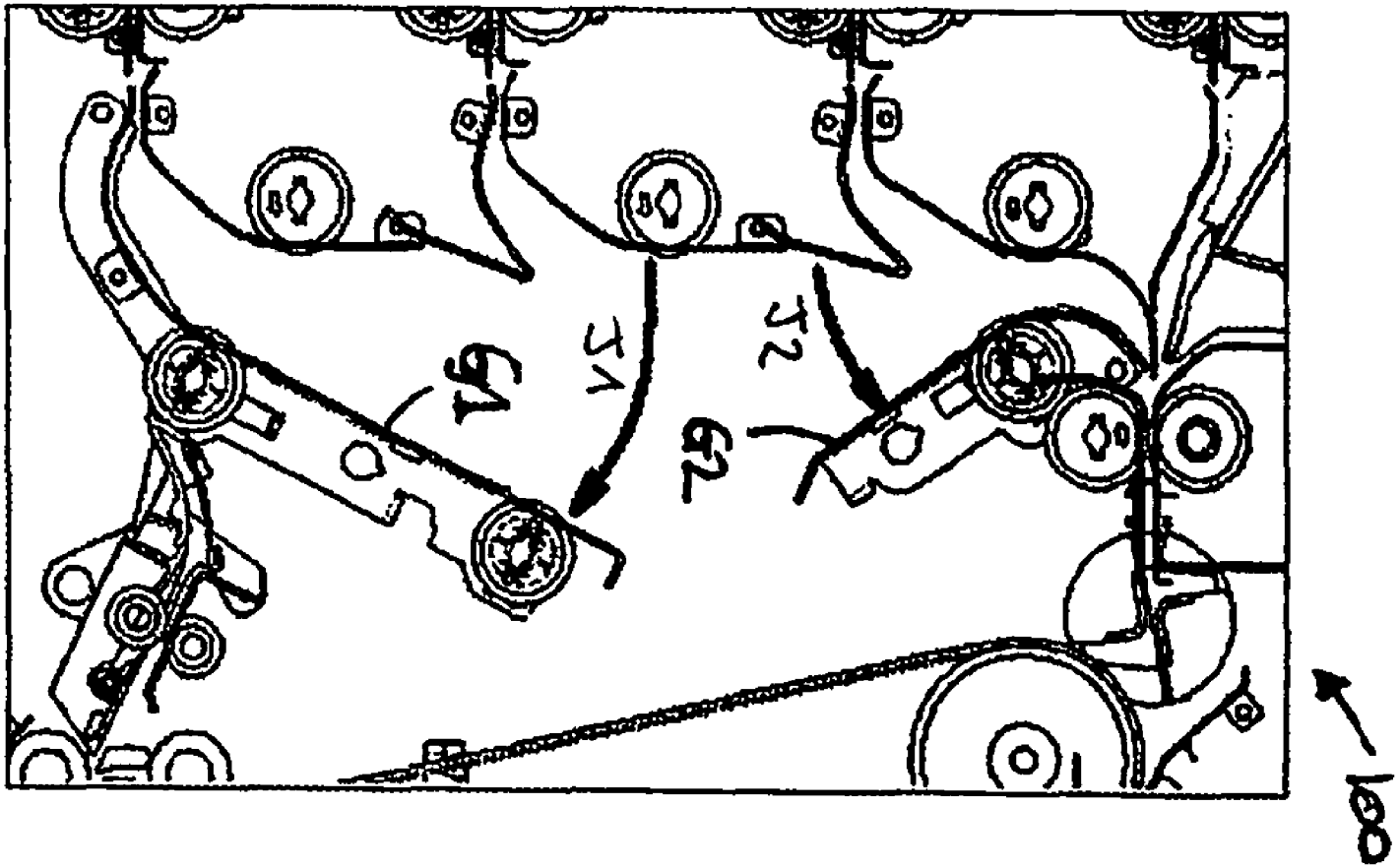
FIG. 9 shows jam access to a collation section in the machine of FIGS. 7 and 8.

To achieve jam access, a single jam access area is located centrally on the machine to facilitate easy access to multiple jam access areas within the machine. This is achieved by having a single jam access door 800 mounted on the front of the machine (as shown in FIGS. 8 and 9) which when opened (FIG. 9) gives access to key areas on the machine. This door is safety interlocked so that when opened it will stop the machine. The key areas that can then be accessed are the collation transport 100 (FIG. 10), accumulator 300 (FIG. 10), the fold system 500 (FIG. 11) and insert collation section 450 (FIG. 12). When the door 800 has been opened, these jam access areas can be opened independently as shown and do not require an interlock on each area as the safety interlock on the main door will shut the machine down.

Figure 7:
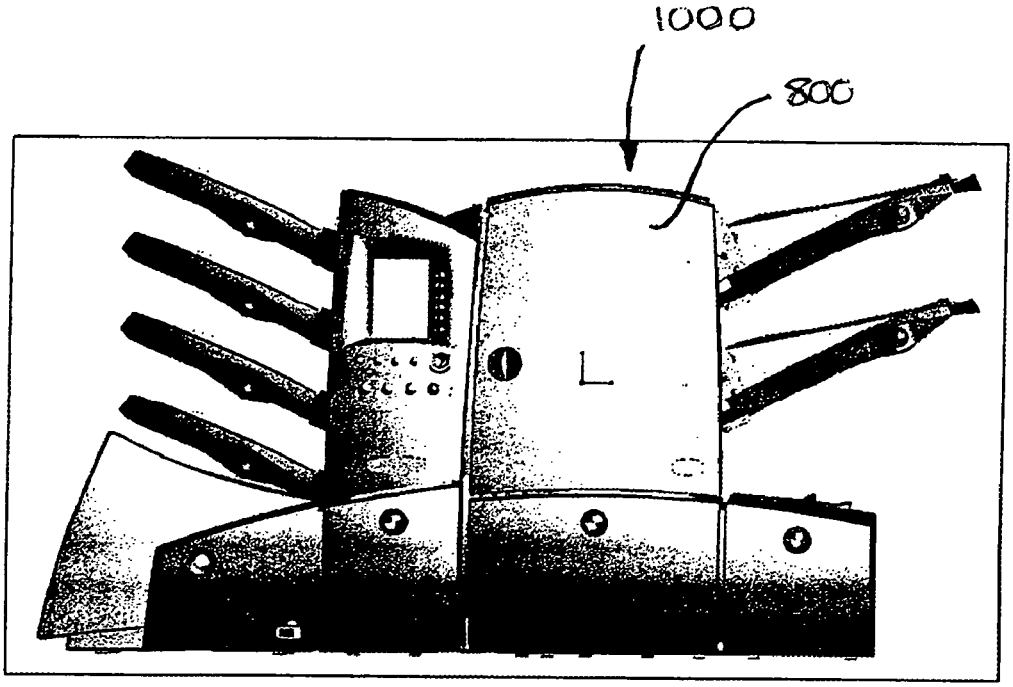
FIG. 7 shows a front view of a folder/inserter machine having a jam access door in a closed position.

As seen in FIGS. 7 and 8, folder/inserter apparatus 1000 is provided with a central jam access door 800. This door is hinged on one side and moves between a locked closed position (FIG. 7) and an open jam access position (FIG. 8). In the closed position, normal operation of the folder/inserter apparatus may continue. However, when the jam access door 800 is opened, the folder/inserter apparatus 1000 is prevented from operating by a suitable switch or controller device which detects whether or not the door is properly closed.

As can be seen from FIG. 8, the central access area provides a user with direct access to substantially the entire sheet feed path along which sheets are fed into the folder/inserter 1000 from sheet feed trays 1, 2, 3 and 4 or via convenience feeder 200. Full access is provided to the collation section 100, the accumulator section 300, the folding section 500, as well as the insert collation section 450. Achieving access to all of these critical sections of the machine via a single access panel 800, requires careful juxtaposition of each of the functional sections of the machine within the apparatus 1000. Not only must the jam access door 800 open proximate to the internal mechanisms of the different machine sections, but the user must be able to gain adequate access to each of the sections to enable any jammed sheet material to be removed from the machine in order to clear obstructions. Moreover, it is necessary for component parts of each section to be able to move relative to one another to provide clearance access.

As shown in FIG. 9, guides G1 and G2 are movable relative to the rest of sheet feeder collation section 100 as indicated by arrows J1 and J2, in order to provide a user with access to the sheet feed path from each of the sheet feeders 2, 3 and 4.

Figure 10:
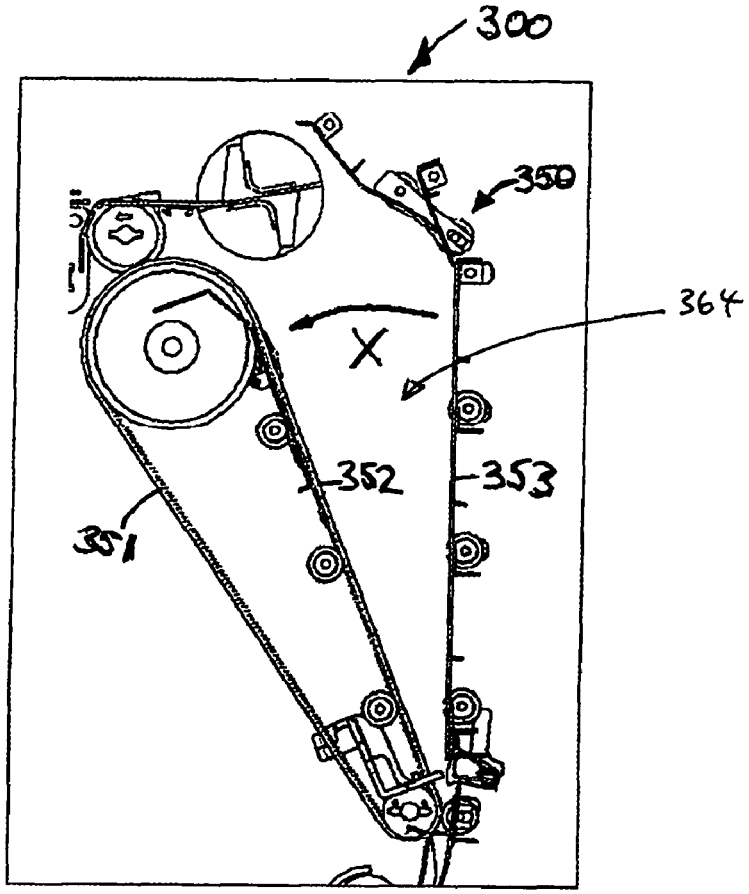
FIG. 10 shows jam access to an accumulator section in the machine of FIGS. 7 and 8.
Figure 11:
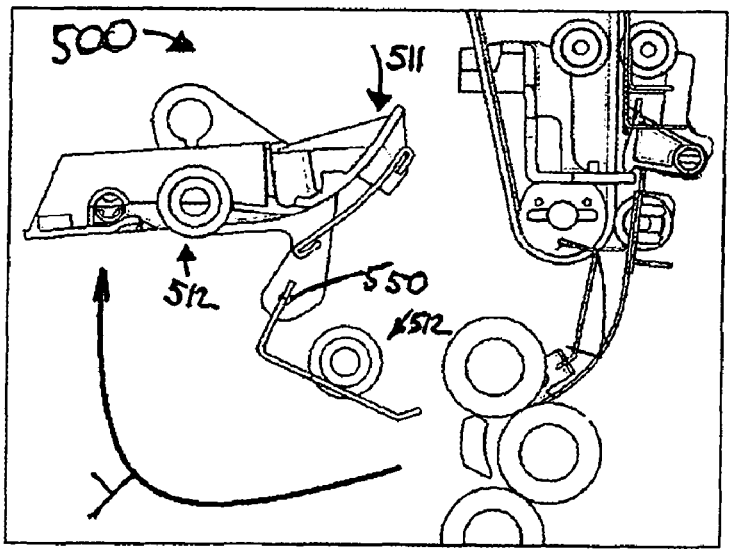
FIG. 11 shows jam access to a folder section in the machine of FIGS. 7 and 8.
Figure 12:
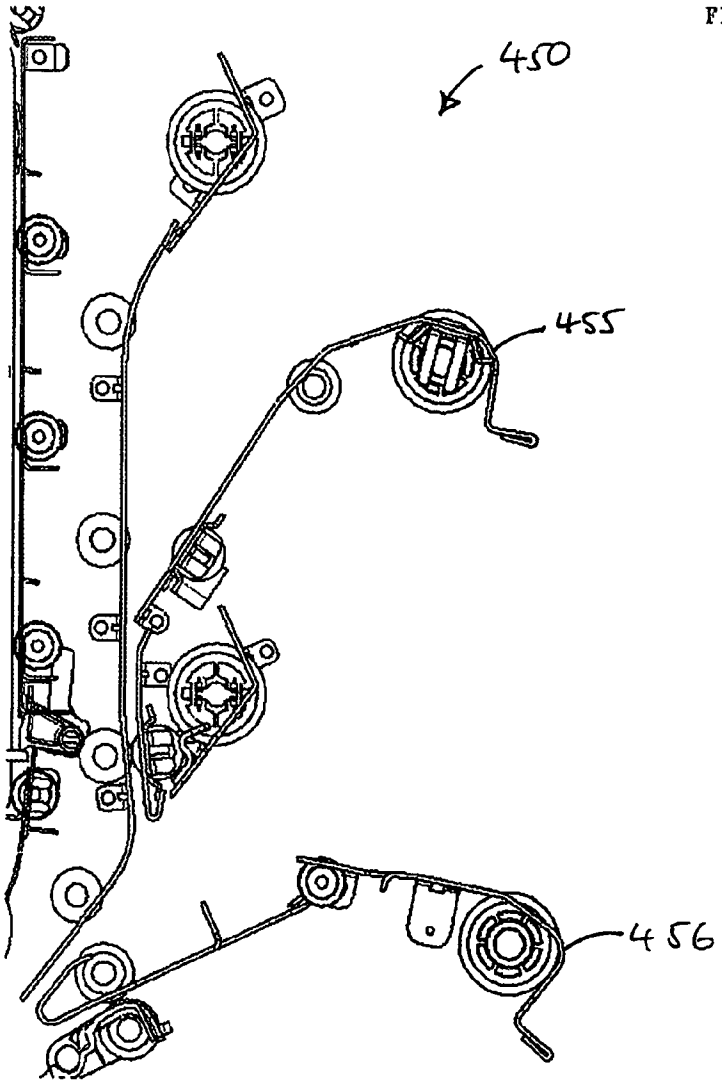
FIG. 12 shows jam access to an insert collation section in the machine of FIGS. 7 and 8.

As shown in FIG. 10, access to the accumulator chamber 364 in the accumulator section 300 is obtained by pivotal rotation of the entire sled guide assembly SG including sled 352 about a lower end thereof relative to fixed guide section 353 as shown by arrow X in FIG. 11. This allows access to the entire accumulation chamber formed between the fixed guide 353 and the movable guide 352.

As shown in FIG. 11, access is gained to the folder section 500 by pivoting part of guide chute 511 and stopping mechanism 512 about a pivot 550 as shown by arrow Y in FIG. 11. This provides access to the entire fold section of the machine which allows a user to remove blocked sheets therefrom.

Referring to FIG. 12, there is shown the insert feeder collation section 450 opened to allow jam access to the insert feeder collation path. Guide sections 455 and 456 which respectively guide inserts from insert feeders 401 and 402 are pivoted about access hinges, thereby moving entire guide sections, as well as driving means, to allow operator access to the insert feeder collation path.

As described herein above, the various machine sections which make up folder/inserter apparatus 1000 must be juxtaposed not only to achieve a compact design, but also to grant access to each of the various machine sections. This is achieved by aligning most of the sections with near-vertical sheet feed paths, having gaps between the adjacent sections, thereby allowing component parts of the sections to be moved or removed in order to allow access to the various sheet feed paths and insert feed paths. By careful arrangement as shown in the disclosed embodiment, all critical component sections at which a jam might typically occur can be accessed via a single access panel 800. This means that a jam or blockage can be easily identified and cured by an operator, without requiring complex diagnostic means, and obviating the need to open a plurality of access panels to check each section individually for jams or sheet blockage.

What is claimed is:

1. A sheet handling device having at least one sheet feed path therethrough from an inlet to an outlet, the sheet feed path defined by guiding means for directing sheet material from the inlet to the outlet, the apparatus comprising:

a plurality of processing sections located along the sheet feed path for performing a plurality of operations on sheet material being handled by the device, said processing sections defining gaps between adjacent processing stations and including an accumulator section, a collation section to produce a collation of sheets, a sheet folding section and an insert feeding section disposed within a main chamber of the sheet handling device, the accumulator section having a vertically oriented feed path to augment mechanical forces by gravitational forces acting on each collation of sheets and being centrally located relative to the other processing sections to facilitate accumulation of sheet material while minimizing gaps between adjacent processing sections and a primary access doorway disposed over the processing stations to facilitate jam clearance.

2. The sheet handling device according to claim 1, wherein each section is defined by component parts comprising guiding means and mechanisms for performing a paper handling operation associated with that section, and component parts in each section are arranged and configured to be movable between a first operational position where they are located during normal operation of the sheet handling device, and a second jam access position where the component is displaced to provide user access to the sheet feed path through that section.

3. The sheet handling device according to claim 2 further comprising a control system, wherein the control system further detects whether each of the movable component parts is in the first position or the second position, and functions to allow operation of the sheet handling device only when all of the component parts are in the first operational position, and to prevent operation of the sheet handling device when any of the component parts is in the second jam access position.

4. The sheet handling device according to claim 1 further comprising a control system, wherein the primary access doorway comprises a hinged panel movable between closed and open positions, and the control system functions to allow operation of the sheet handling device when the hinged panel is in the closed position and prevents operation of the sheet handling device when the hinged panel is in the open position.

5. The sheet handling device according to claim 4 having at least one further secondary access panel to provide a user with access to the envelope feed path.

6. The sheet handling device according to claim 5, wherein said secondary access panel is arranged to operate means to stop operation of said apparatus when open.

7. The sheet handling device according to claim 6, wherein said secondary access panel is arranged to operate means to stop operation of said apparatus when open.

8. The sheet handling device according to claim 4 wherein said hinged panel is arranged to operate means to stop operation of said apparatus when open.

9. The sheet handling device according to claim 1, further comprising an envelope feed path, the envelope feed path having a different inlet to the sheet feed path, the envelope feed path joining the sheet path in the region of a flapper section for inserting sheet material into an envelope and having the same outlet as the sheet feed path.

* * * * *